US007635272B2

(12) United States Patent
Poppe

(10) Patent No.: US 7,635,272 B2
(45) Date of Patent: Dec. 22, 2009

(54) USB PORT LOCKING AND BLOCKING DEVICE

(75) Inventor: Carl H. Poppe, Sebastopol, CA (US)

(73) Assignee: Acco Brands USA LLC, Lincolnshire, IL (US)

( * ) Notice: Subject to any disclaimer, the term of this patent is extended or adjusted under 35 U.S.C. 154(b) by 245 days.

(21) Appl. No.: 11/893,876

(22) Filed: Aug. 17, 2007

(65) Prior Publication Data

US 2008/0041125 A1 Feb. 21, 2008

Related U.S. Application Data

(60) Provisional application No. 60/838,591, filed on Aug. 17, 2006.

(51) Int. Cl.
*H01R 13/44* (2006.01)

(52) U.S. Cl. ..... 439/133; 70/14; 70/58

(58) Field of Classification Search ..... 439/133, 439/134; 70/14, 58, 491, 496, 361
See application file for complete search history.

(56) References Cited

U.S. PATENT DOCUMENTS 4,924,683 A 5/1990 Derman
5,987,937 A 11/1999 Lee
6,745,330 B1 6/2004 Maillot
6,811,415 B2 11/2004 Chen
6,991,479 B2 * 1/2006 Miao ..... 439/133
7,160,137 B1 * 1/2007 Yeh ..... 439/358
7,428,834 B1 * 9/2008 Lee ..... 70/57
7,462,045 B1 * 12/2008 Lee ..... 439/133
2003/0224637 A1 12/2003 Ling
2004/0074264 A1 * 4/2004 Kung et al. ..... 70/58
2005/0039502 A1 * 2/2005 Avganim ..... 70/58
2005/0202698 A1 9/2005 Miao

FOREIGN PATENT DOCUMENTS

JP 2004-087462 3/2004

* cited by examiner

*Primary Examiner*—Gary F. Paumen
(74) *Attorney, Agent, or Firm*—Townsend and Townsend and Crew LLP

(57) ABSTRACT

Locking and blocking devices for USB ports include a lock having a linear cam with a lock button at its back end, and a locking member pivotally connected at its back end to a retaining sheath such that forward sliding of the linear cam pivots the locking member outwards. The front end of the locking member is biased toward the interior of the lock. The locking member has protrusions at its front end configured for insertion into holes of a USB port. A blocking plate includes at least one opening configured for insertion of the retaining sheath. A retaining bracket has a back face that defines a first opening, wider than the cable that connects a plug to an external device. The front face of the bracket defines a second opening configured for insertion of the retaining sheath, and a third opening configured for insertion of the plug.

13 Claims, 16 Drawing Sheets

USB PORT LOCKING AND BLOCKING DEVICE

CROSS-REFERENCE TO RELATED APPLICATION

This application claims priority to, and the benefit of, U.S. Provisional Application No. 60/838,591, filed on Aug. 17, 2006, the entire contents of which are incorporated herein by reference.

BACKGROUND OF THE INVENTION (a) Field of the Invention

The present invention relates to a lock for USB ports on personal computers and other electronic devices. More particularly, the present invention relates to a locking device for locking and/or blocking a USB port and adjacent ports to prevent use of or removal of a cable from one or more ports.

(b) Description of the Related Art

Generally, universal serial bus (USB) ports provide a serial bus standard for connecting devices to computers. Most modern computers include at least one USB port. USB ports can also be used on video game consoles and personal digital assistants (PDAs), and even devices like televisions and home stereo equipment. They are used to connect peripherals such as mice, keyboards, gamepads, joysticks, scanners, digital cameras, printers, external storage, etc.

In addition, anyone with access to a computer's USB port can plug a portable flash drive or the like into the port and download information from the computer. This can be a security problem.

While others have attempted to solve this problem with locks including a control shaft which, when slid forward (i.e. toward the USB port), forces a claw on the back end of a resilient tab outward into a slot in the USB port, such a claw may become jammed inward with too much force or bent out of shape with repeated use. In addition, such a lock is capable of blocking use of only a single USB port, and does not address the issue of necessary external devices such as keyboards and mice. An example of such a lock is shown, for example, in U.S. Patent Application Publication no. 2003/0224637 to Ling.

Therefore, it would be desirable to provide a lock for a USB port with a more reliable securement mechanism, as well as a lock capable of blocking use of more than one port simultaneously and/or locking necessary external devices in place.

The above information disclosed in this Background section is only for enhancement of understanding of the background of the invention and may contain information that does not form the prior art that is already known in this country to a person of ordinary skill in the art.

SUMMARY OF THE INVENTION

A USB port lock according to an exemplary embodiment of the present invention includes a linear cam with a lock button at its back end, and a locking member pivotally connected at its back end to a retaining sheath, onto which a lock housing is mounted. The locking member's back end is bent, such that its front end is biased toward the interior of the lock. The locking member has protrusions on its front end, configured for insertion into openings of a USB port. When the lock button is depressed, the linear cam moves forward, pivoting the locking member such that its front end moves outward. The protrusions are then disposed in the holes of the USB port, securing the lock to the port.

In a first exemplary embodiment, a locking mechanism includes a front spring-loaded set of pins, which is biased backwards, cooperating with a rear set of pins. A locking latch cooperates with a notch in the lock housing to restrict rearward movement of the locking mechanism and linear cam. A linear cam return spring biases the locking mechanism and linear cam rearward, and a locking latch return spring biases the rear portion of the locking mechanism sideways, at which position the locking latch prevents rearward movement of the linear cam, retaining the lock in its locked position.

In a second exemplary embodiment, a locking mechanism includes an actuating member, such as a cable, and a separate lock. An internal return spring releases the locking mechanism upon removal of the actuating member.

A blocking plate according to an exemplary embodiment the present invention includes at least one opening slightly larger than the exterior dimensions of the retaining sheath of the lock, but smaller than the exterior dimensions of the lock housing. The retaining sheath is placed through the opening before the lock is inserted in the USB port.

A retaining bracket, according to an exemplary embodiment of the present invention, keeps a USB plug in a USB port adjacent the port to which the lock is secured. The retaining bracket has a front face that defines an opening slightly larger than the exterior dimensions of the retaining sheath, but smaller than the exterior dimensions of the lock housing. The front face also defines an opening that is slightly larger than the exterior dimensions of the USB plug. The bracket's back face defines an opening slightly wider than the cable that connects the plug to an external device.

DETAILED DESCRIPTION OF THE PREFERRED EMBODIMENTS

Exemplary embodiments of the present invention will hereinafter be described in detail with reference to the accompanying drawings.

Figure 1:
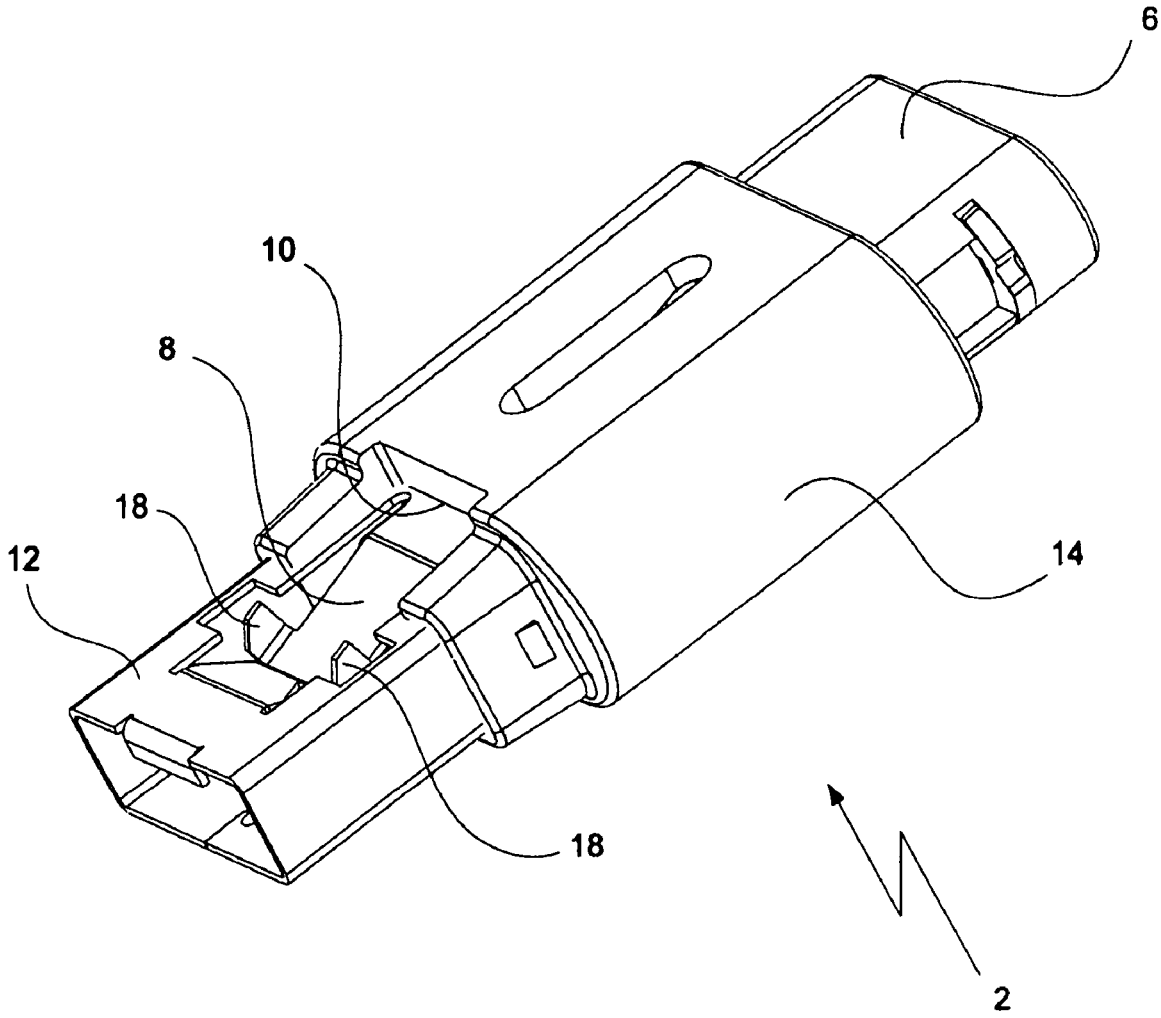
FIG. 1 is a perspective view of a USB lock in the unlocked state according to an exemplary embodiment of the present invention.
Figure 2:
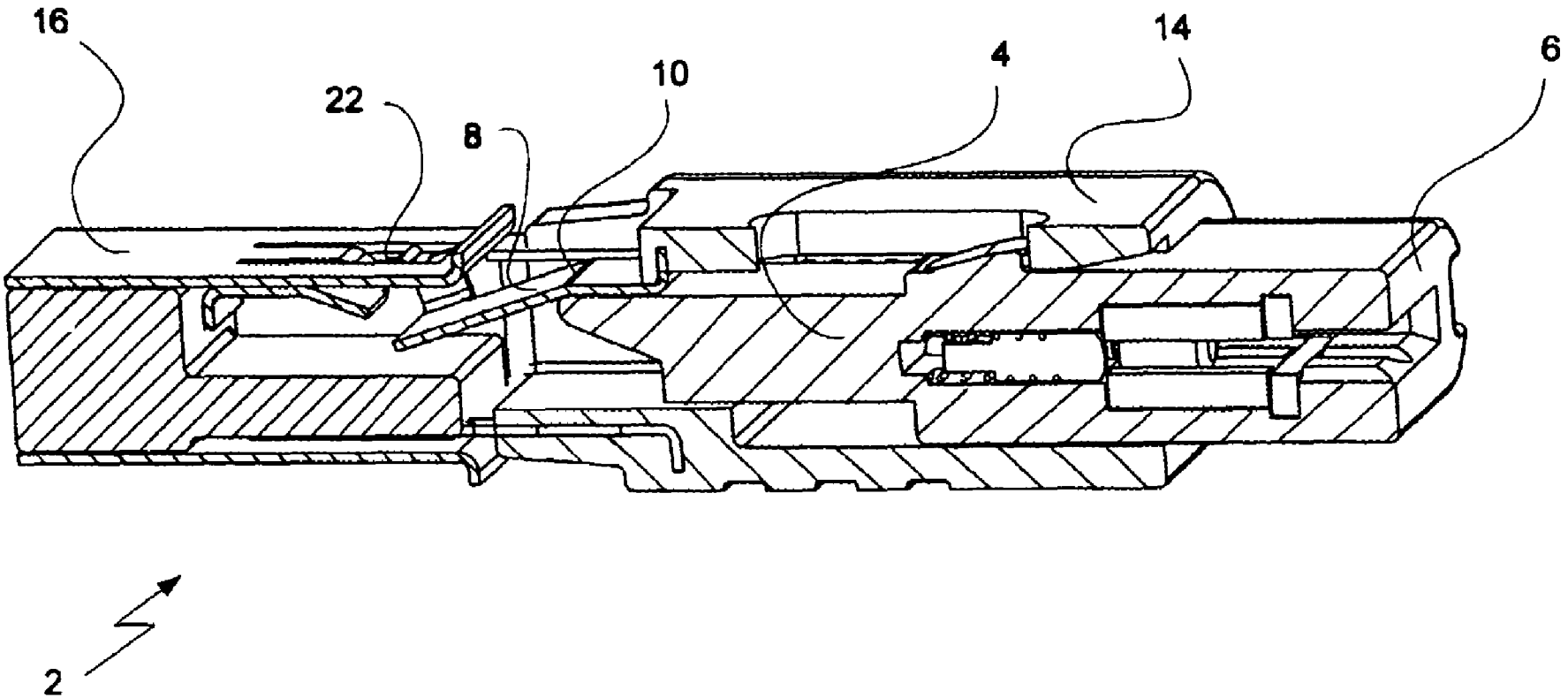
FIG. 2 is a cross-sectional perspective view of the lock of FIG. 1 cooperating with a USB port of an electronic device in the unlocked state.
Figure 3:
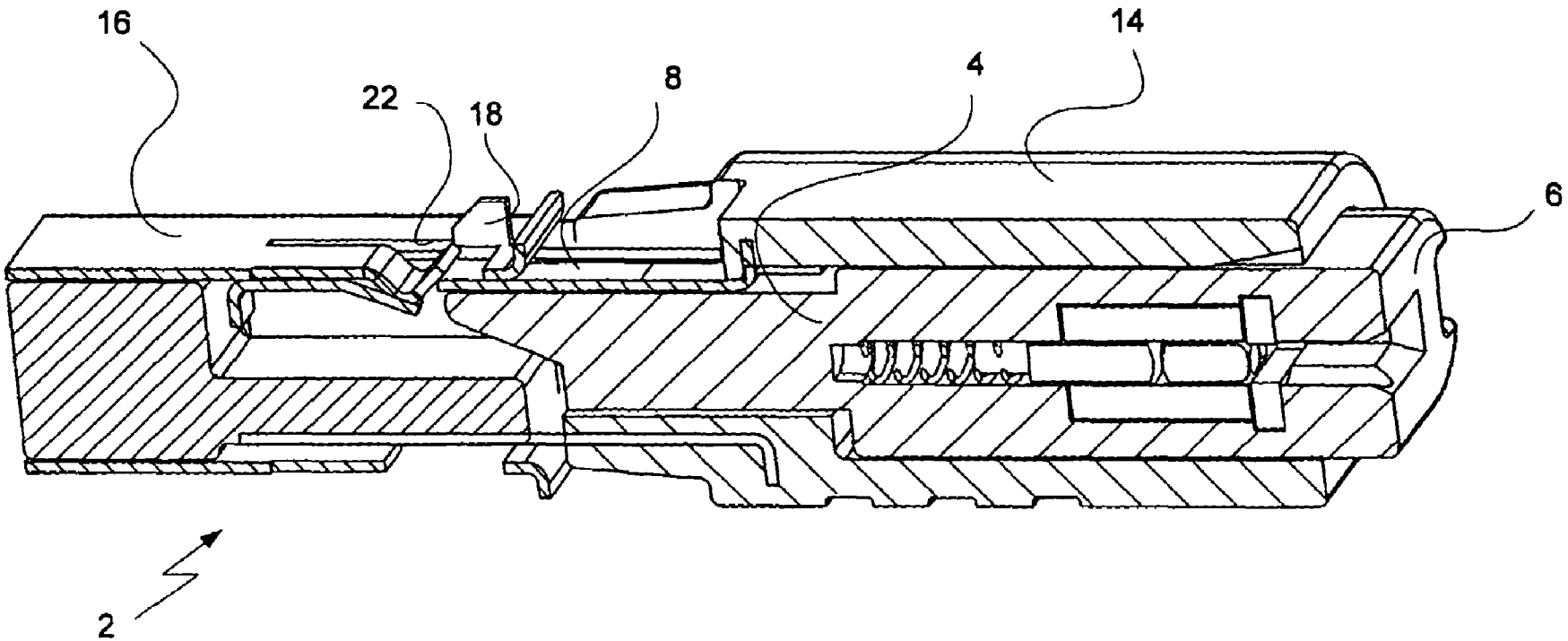
FIG. 3 is a cross-sectional perspective view of the lock of FIG. 1 cooperating with a USB port of an electronic device in the locked state.

Referring to FIG. 1, an exemplary embodiment of the present invention provides a lock 2 with a housing 14 mounted onto a retaining sheath 12, which is insertable to a USB port. Locking member 8 is pivotally connected to the rear end of retaining sheath 12. Locking member 8 is provided with two protrusions 18, which correspond to standard openings in a USB port. Locking member 8 has a bent, preformed shape, such that in the absence of external forces it runs diagonally; its front end is farther inward than its back end 10. Lock 2 further includes lock button 6 which protrudes from the rear end of housing 14. Lock button 6 is depressible by a user to lock the lock 2. Referring also to FIGS. 2 and 3, lock button 6 is connected to linear cam 4, which pivots locking member 8 by cooperating with the ramped camming surface of locking member 8.

Retaining sheath 12 and locking member 8 may be made of steel and lock housing 14 may be made of polycarbonate and over-molded on retaining sheath 12. Lock 2 is thus resistant to being bent, broken, or crushed during storage or by a would-be thief. In addition, throughout repeated pivoting of locking member 8, the structural integrity of its back end 10 is not compromised.

FIGS. 2 and 3 are shown with the basic structure of a USB port 16 exposed so as to reveal the cooperation of lock 2 with the USB port 16. To lock use of USB port 16, a user inserts lock 2 into USB port 16 and depresses lock button 6, which is retained in the depressed position by means of locking mechanism 24, 50, which will be described below with reference to FIGS. 4-6. Linear cam 4 moves forward, pivoting locking member 8 outwards until it is at least approximately parallel to linear cam 4 and to the interior surface of USB port 16. Protrusions 18 on locking member 8 then protrude through opening 20 in retaining sheath 12, and into openings 22 in USB port 16, securing lock 2 to USB port 16. Protrusions 18 may be along the edges of locking member 8 and may be formed by bending up a portion of the material.

To unlock lock 2 and allow use of USB port 16, a user unlocks the locking mechanism, allowing linear cam 4 to slide back to its start position. Locking member 8 thus deflects to return to its preformed diagonal disposition. In this state, protrusions 18 are completely disposed within the interior of retaining sheath 12, and thus do not interfere with openings 22 in USB port 16, allowing lock 2 to be removed from USB port 16.

Figure 4:
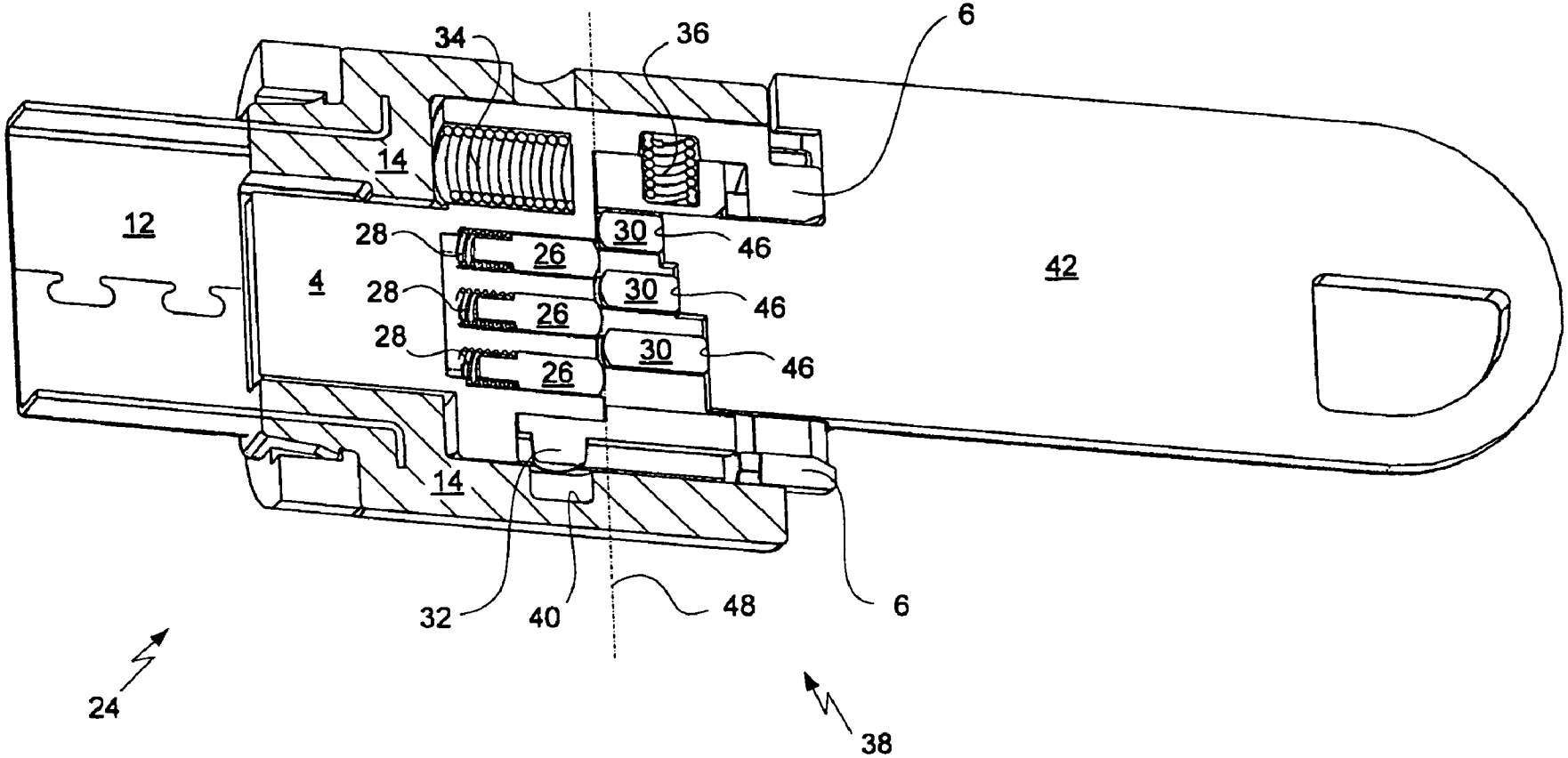
FIG. 4 is a cross-sectional perspective view of a first exemplary locking mechanism of the lock of FIG. 1.

Referring to FIG. 4, in a first exemplary embodiment, locking mechanism 24 includes two sets of pins: a front spring-loaded set 26 which is biased backwards by springs 28, and a rear set 30 with an equal number of pins. Locking latch 32 cooperates with notch 40 to restrict rearward movement of locking mechanism 24. Linear cam return spring 34 biases locking mechanism 24 rearward, and locking latch return spring 36 biases the rear portion 38 of locking mechanism 24 sideways (down in FIG. 4).

When lock button 6 is depressed, locking latch return spring 36 forces the rear part 38 of locking mechanism 24 over (down), and locking latch 32 prevents it from moving rearward by means of its engagement with notch 40 in housing 14. Because lock button 6 is connected to linear cam 4, this keeps linear cam 4 forward and lock 2 in its locked position as seen in FIG. 3.

To unlock locking mechanism 24, a user inserts key 42 until its forward surface 44 abuts the rear surface of lock button 6. At this point, the rear pins 30 have been pushed by the biting 46 on key 42 until their forward surfaces are at shear line 48, and they, in turn, have pushed forward pins 26 until their rear surfaces are at shear line 48. Key 42 is now slid over (up in FIG. 4) against locking latch return spring 36, taking with it the rear portion 38 of locking mechanism 24, including locking latch 32 which no longer restrains rearward motion of locking mechanism 24. Linear cam return spring 34 forces the entire locking mechanism 24 rearward, taking with it linear cam 4 and thus releasing lock 2 to its unlocked position as seen in FIGS. 1 and 2, allowing it to be removed from USB port 16.

Figure 5:
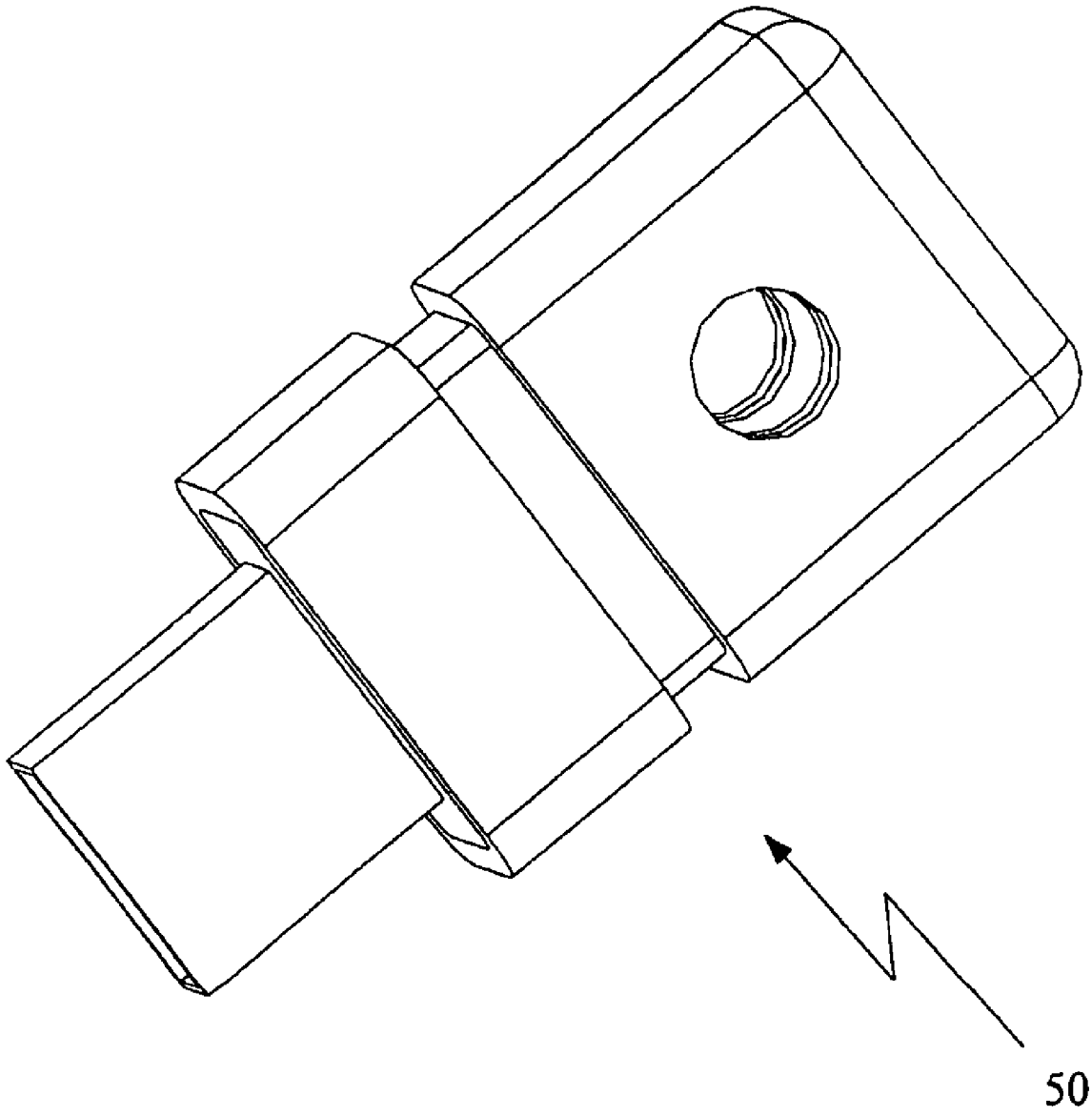
FIGS. 5 and 6 are perspective views of a second exemplary locking mechanism of the lock of FIG. 1.
Figure 6:
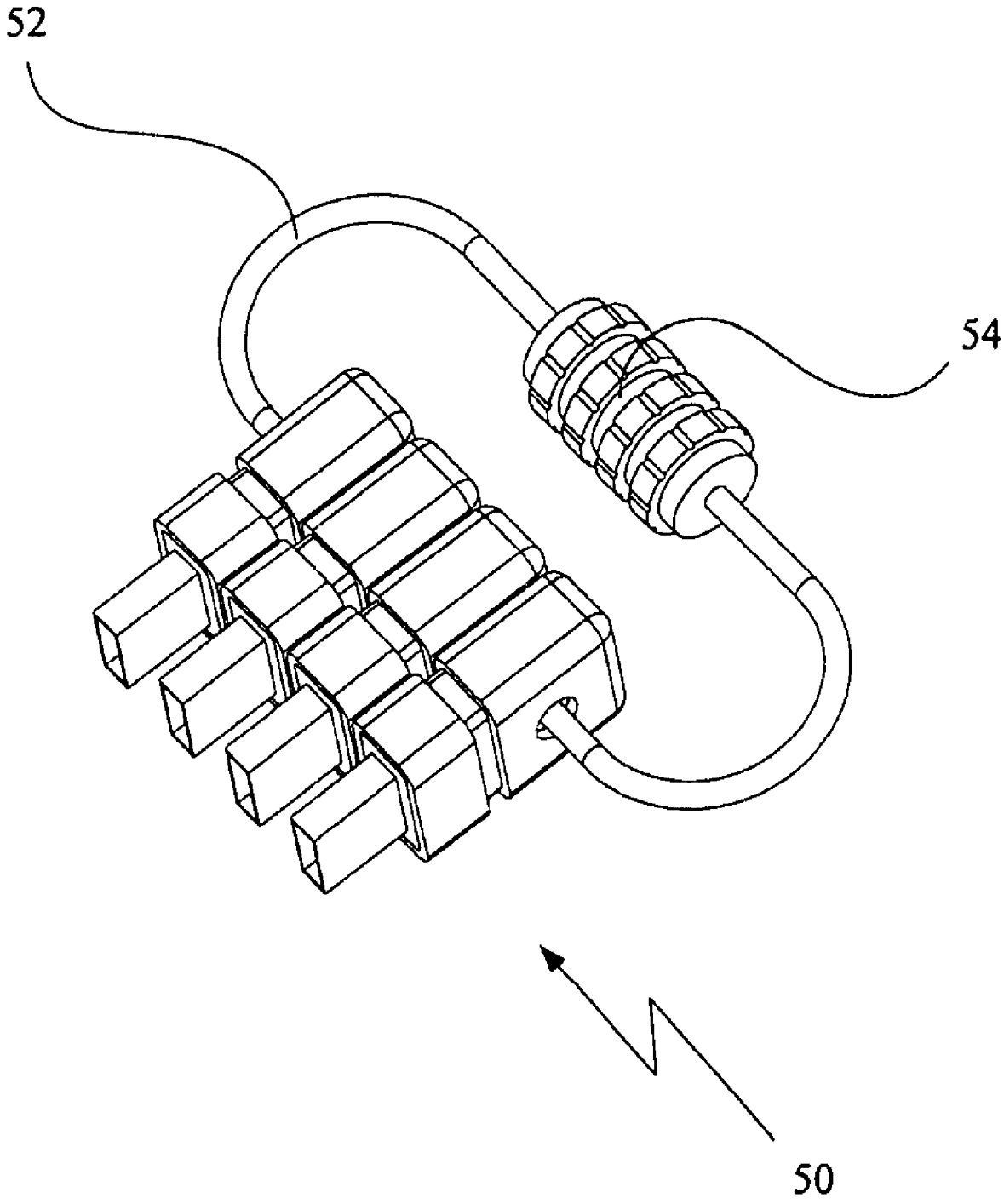

Referring to FIGS. 5-6, in a second exemplary embodiment, locking mechanism 50 includes an actuating member 52 and lock 54. When the actuating member 52 is removed, an internal return spring (not shown) releases locking mechanism 50. Actuating member 52 may comprise a cable or other partly flexible member. Alternatively, the hasp of a padlock (not shown) could be inserted directly to locking mechanism 50.

While exemplary locking mechanisms 24, 50 have been described for illustrative purposes, it will be appreciated that the invention is not limited thereto. For example, a cylindrical multiple dial combination lock as shown in the Assignee's copending U.S. application Ser. No. 11/821,463, Master Keyed Combination Lock, filed Jun. 22, 2007, may be easily adapted for use in the present invention by configuring the lock shaft disclosed therein to cooperate with linear cam 4. The said copending U.S. patent application is incorporated herein by reference in its entirety.

Figure 7:
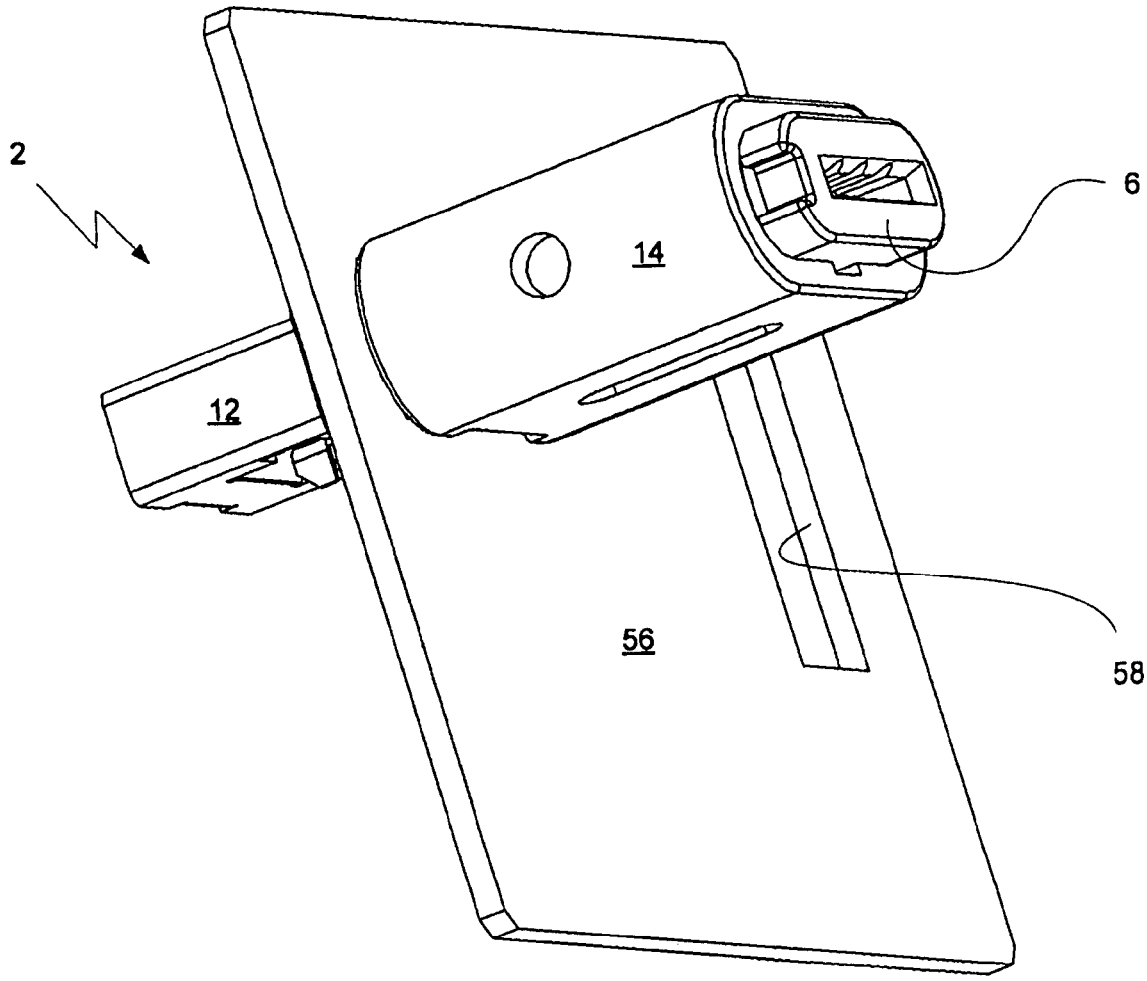
FIG. 7 is a perspective view of the lock of FIG. 1 and an exemplary blocking plate.
Figure 7B:
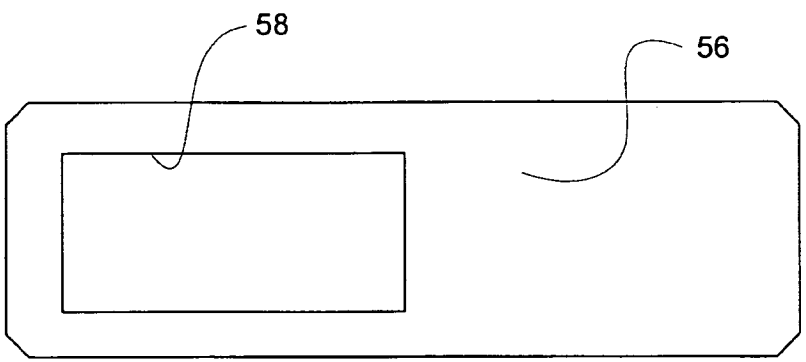
FIGS. 7A-7C are front views of first through third exemplary blocking plates.
Figure 7A:
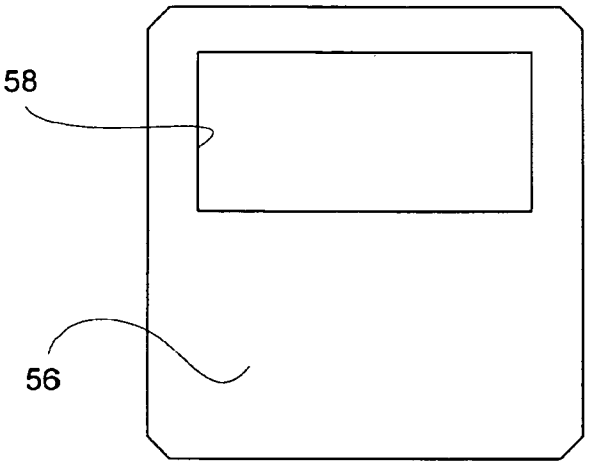
Figure 7C:
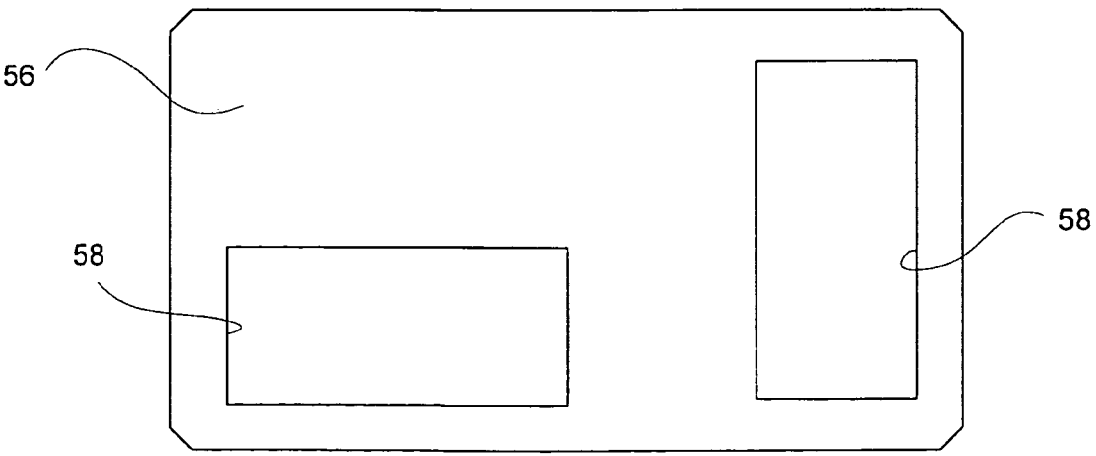
Figure 8:
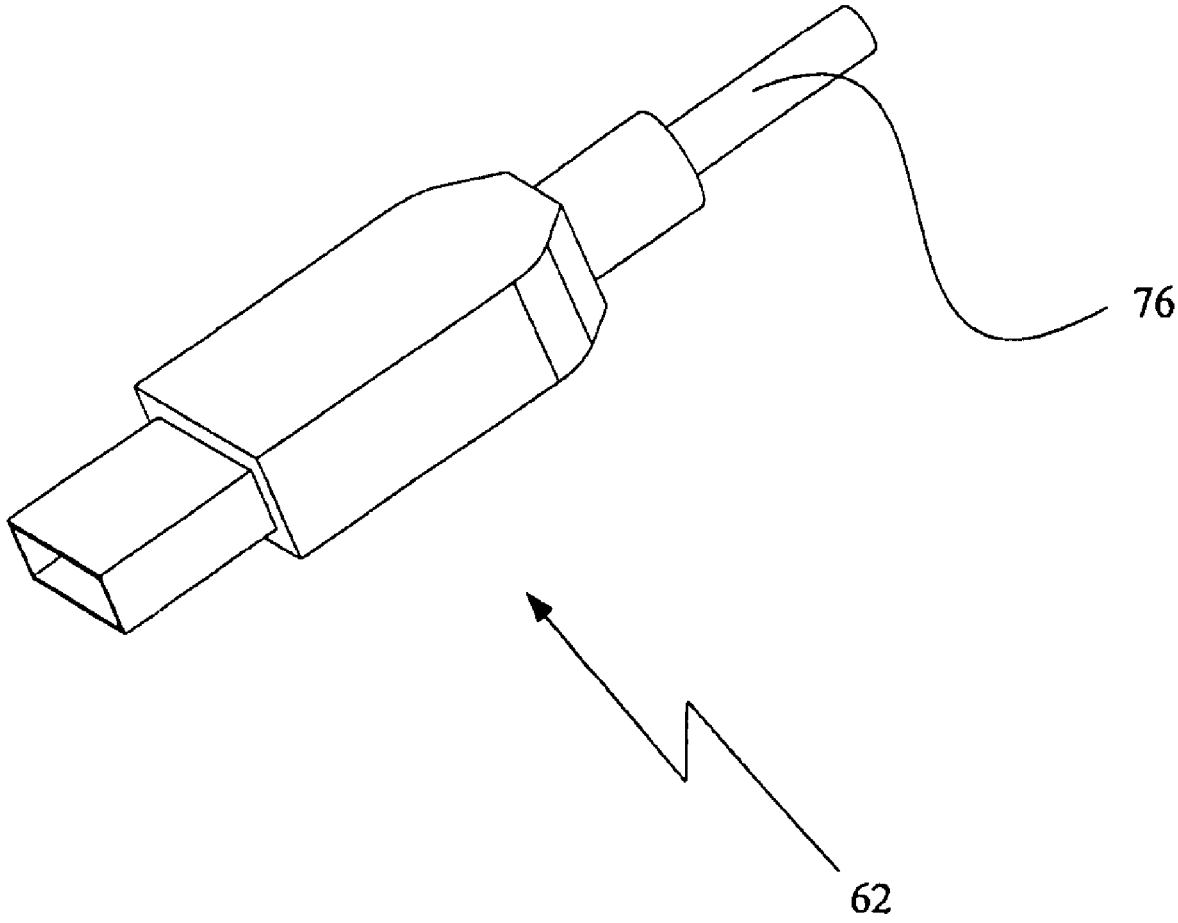
FIG. 8 is a perspective view of a USB plug.
Figure 9:
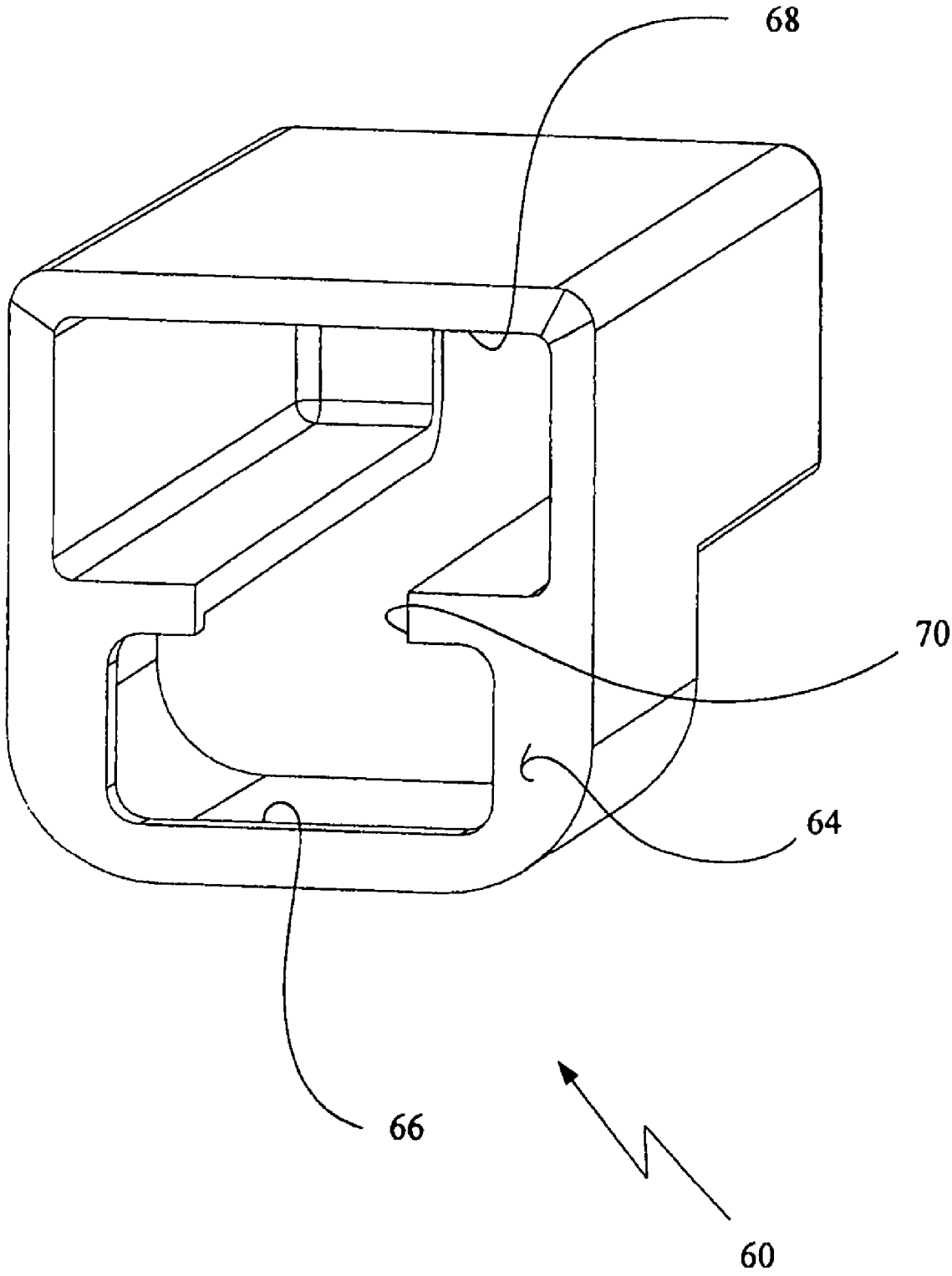
FIG. 9 is a front perspective view of a first exemplary embodiment of a retaining bracket.
Figure 10:
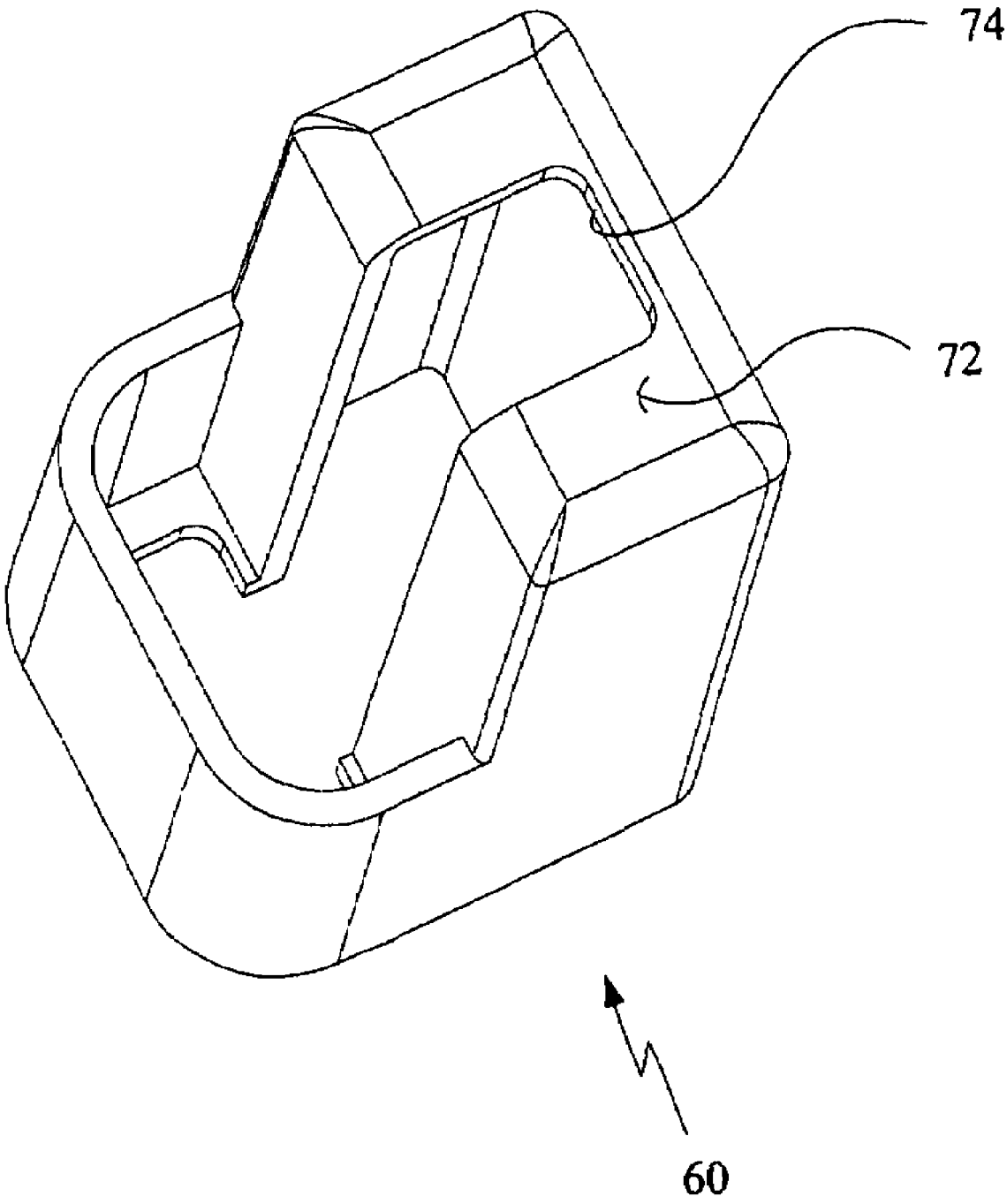
FIG. 10 is a side perspective view of the retaining bracket of FIG. 9.

Referring to FIGS. 7-7C, in a further exemplary embodiment, a blocking plate 56 includes at least one opening 58 slightly larger than the exterior dimensions of retaining sheath 12, but smaller than the exterior dimensions of lock housing 14. Retaining sheath 12 is inserted in opening 58 before lock 2 is inserted in USB port 16, such that once lock 2 has been secured to USB port 16, plate 56 cannot be removed from lock 2 and adjacent USB ports are blocked from use by blocking plate 56. In some embodiments, as illustrated in FIGS. 7A-7B, only one opening 58 is provided in plate 56. FIG. 7A illustrates a blocking plate 56 configured to block access to a USB port in a "vertical" configuration with the port 16, i.e. below the opening 58 in the Figure. FIG. 7B illustrates a plate 56 configured to block a port in a "side-by-side" configuration the port 16, i.e. to the right of the opening 58 in the Figure. In a further exemplary embodiment, as illustrated in FIG. 7C, blocking plate 56 includes two openings 58 whose lengthwise axes are substantially perpendicular to one another, such that blocking plate 56 can be used on a variety of computer makes and models with different numbers and configurations of USB ports. (It should be noted that ports are typically parallel to one another; thus whichever opening 58 is not used does not provide access to a nearby port.) Alternatively, the dimensions of blocking plate 56 and the configuration of opening 58 may be specific to the make and model of computer for which blocking plate 56 is being used.

Referring to FIGS. 8-10 and 13, retaining bracket 60, according to a first exemplary embodiment, keeps USB plug 62 in a USB port adjacent port 16 in the "vertical" configuration. Retaining bracket 60 has a front face 64 that defines an opening 66 slightly larger than the exterior dimensions of retaining sheath 12, but smaller than the exterior dimensions of lock housing 14, such that bracket 60 can be secured to port 16 in the same manner as blocking plate 56, as described above. It also defines an opening 68 that is slightly larger than the exterior dimensions of plug 62, and a central channel 70, slightly wider than plug 62, that connects openings 66, 68. The bracket's back face 72 defines an opening 74 which is slightly wider than cable 76 which connects plug 62 to an external device such as, for example, a mouse or a keyboard.

Figure 11:
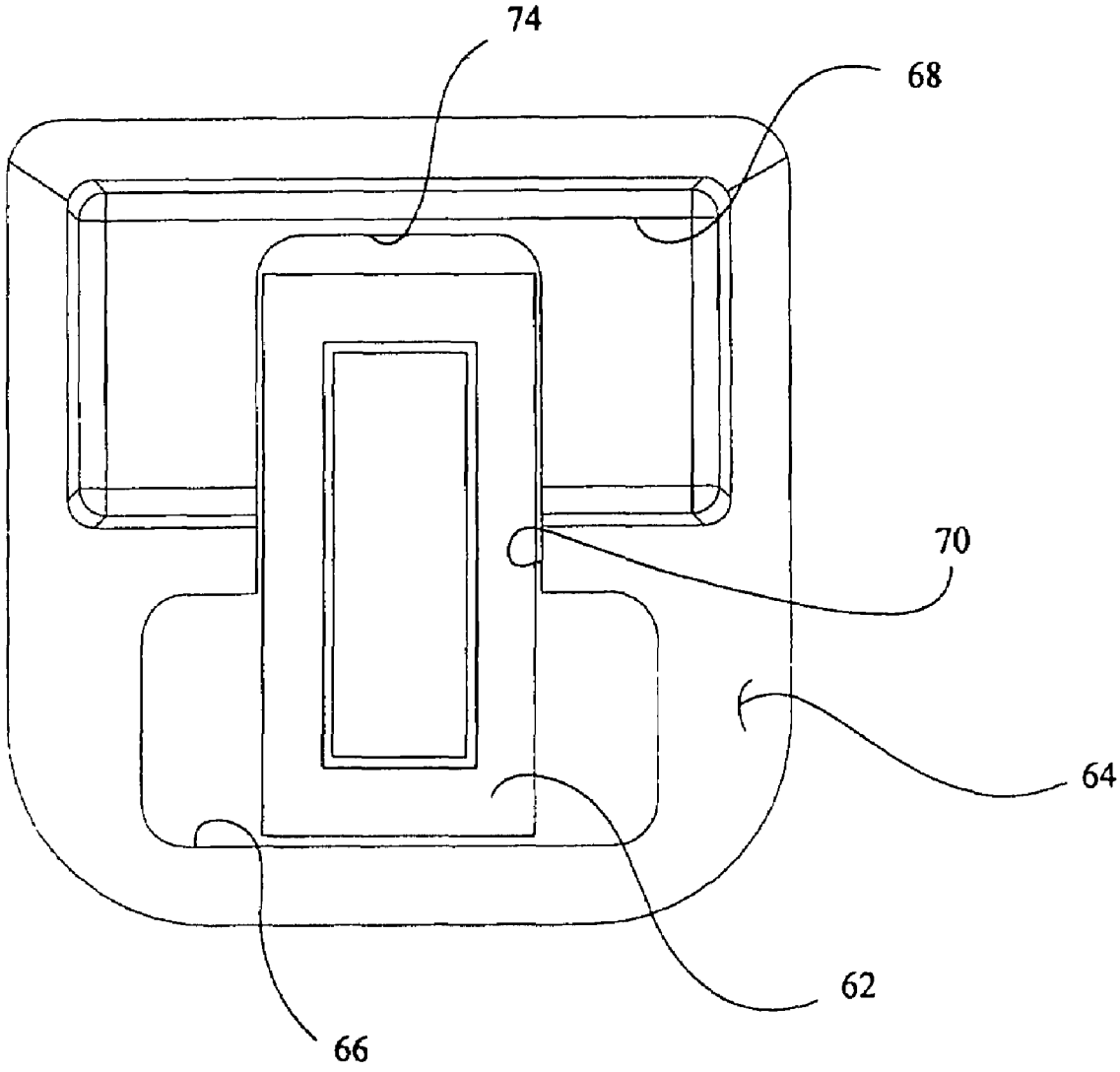
FIG. 11 is a front view of the retaining bracket of FIG. 9 with the plug of FIG. 8 being inserted thereto.
Figure 12:
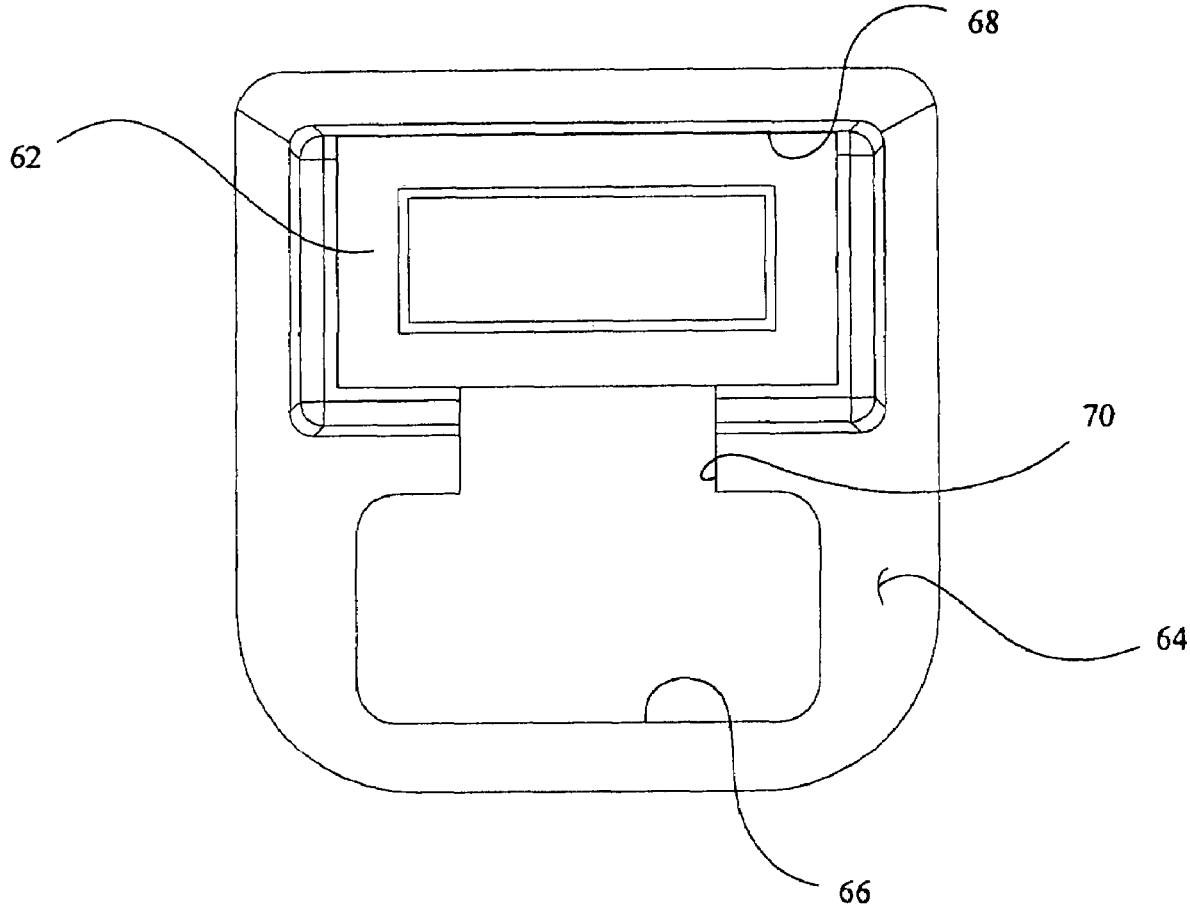
FIG. 12 is a front view of the retaining bracket and plug of FIG. 11 after insertion of the plug.
Figure 13:
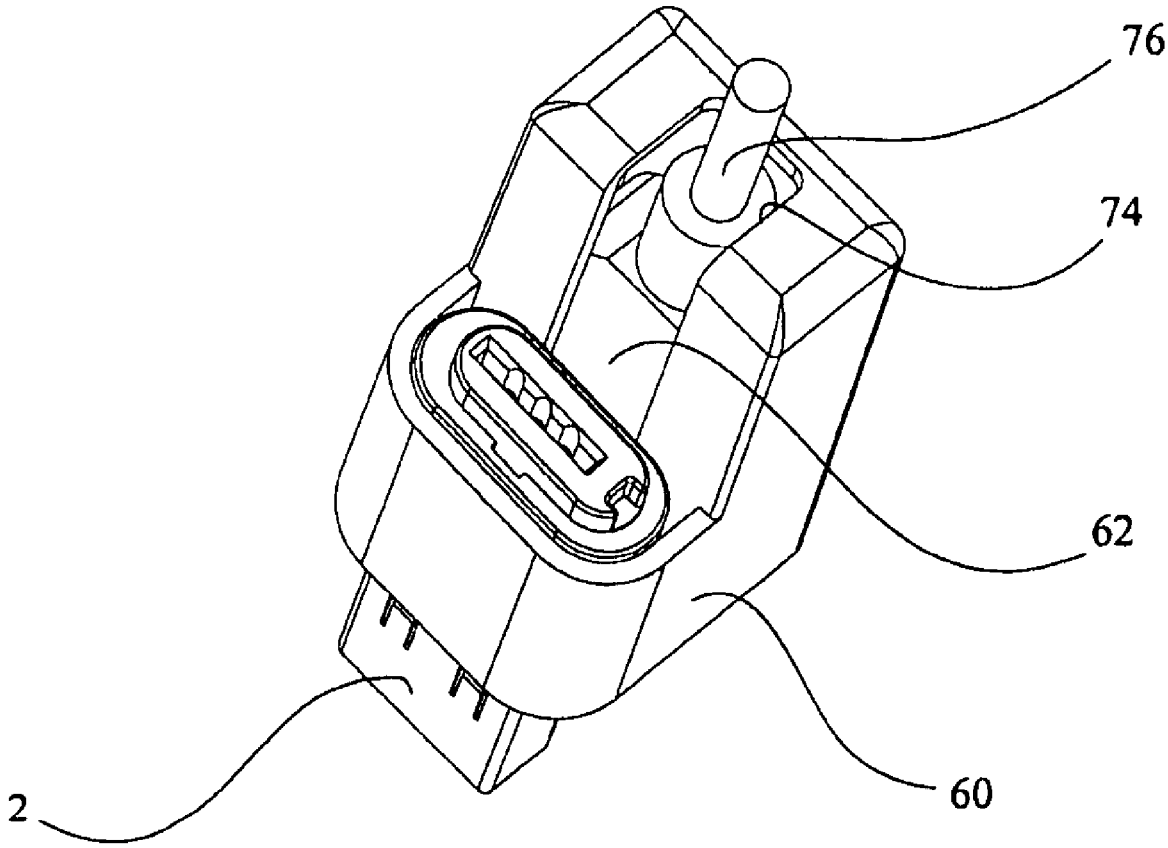
FIG. 13 is a side perspective view of the retaining bracket of FIG. 9, the lock of FIG. 1, and the plug of FIG. 8 after insertion of the plug and lock to the retaining bracket.

To lock plug 62 to a port adjacent port 16, a user first inserts plug 62 to retaining bracket 60 in the orientation seen in FIG. 11. Plug 62 is pulled all the way through bracket 60 in this orientation and then rotated 90° and slid to the orientation seen in FIG. 12. Plug 62 is pulled back through bracket 60 in this orientation to the position seen in FIG. 13. In this orientation, it cannot be removed by pulling backwards, as opening 74 is not big enough to allow plug 62 through. Lock 2 is then inserted to opening 66 and locked to USB port 16 as described above. Bracket 60 thus cannot be pulled backward because of lock 2 interfering with front face 64, and both ports are blocked from use.

Figure 14:
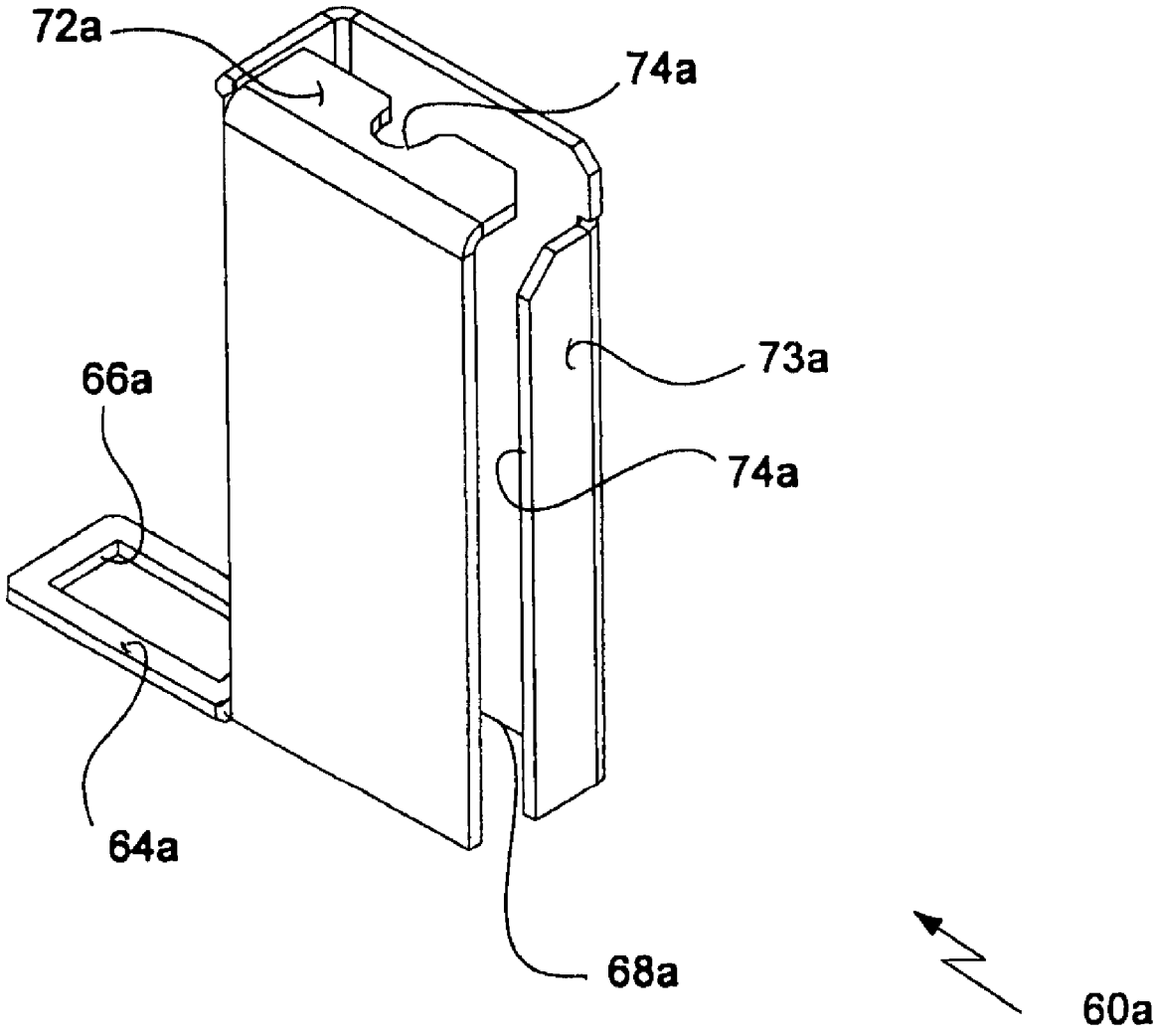
FIG. 14 is a perspective view of a second exemplary embodiment of a retaining bracket.
Figure 15:
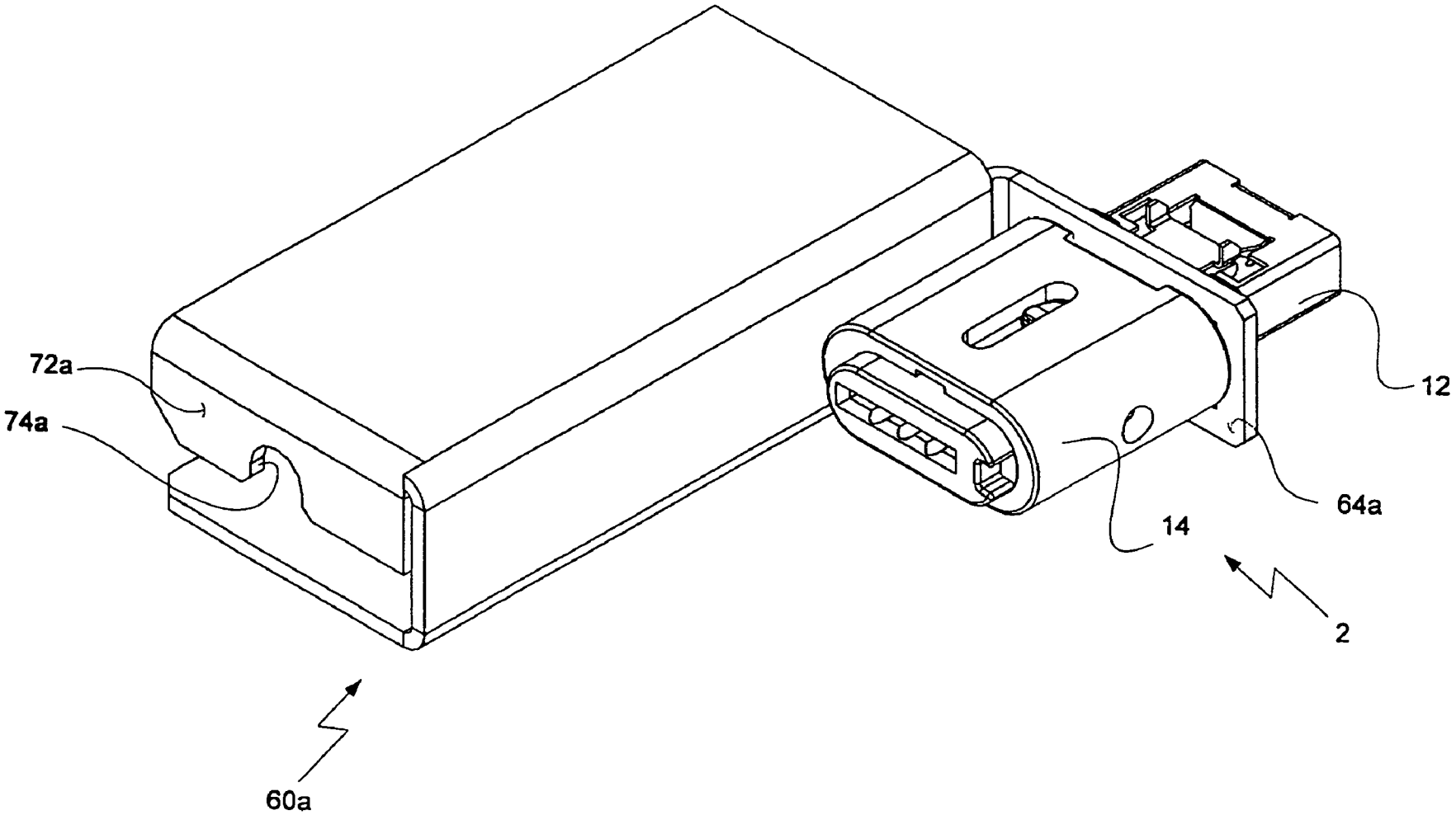
FIG. 15 is a perspective view of the retaining bracket of FIG. 14 after insertion of the lock of FIG. 1.

In an alternative embodiment, as illustrated in FIGS. 14-15, retaining bracket 60*a* keeps USB plug 62 in a USB port adjacent port 16 in the "side-by-side" configuration. Retaining bracket 60*a* has a front face 64*a* that defines an opening 66*a* slightly larger than the exterior dimensions of retaining sheath 12, as described above. It also defines an opening 68*a* that is slightly larger than the exterior dimensions of plug 62. The bracket's back face 72*a*, and side face 73*a*, define an opening 74*a* which is slightly wider than cable 76.

To lock plug 62 to a port adjacent port 16, a user first inserts plug 62 to retaining bracket 60*a* by placing the plug 62 below the bracket 60*a* in FIG. 14, and pressing the cable 76 through the portion of the opening 74*a* on the side face 73*a*. The user then pulls the plug 62 upwards in FIG. 14 and secures the cable 76 in the portion of the opening 74*a* on the back face 72*a*. In this orientation, the plug 62 cannot be removed by pulling backwards, as opening 74*a* is not big enough to allow the plug 62 through. Lock 2 is then inserted to opening 66*a* and locked to USB port 16 as described above. Bracket 60*a* thus cannot be pulled backward because of lock 2 interfering with front face 64*a*, and both ports are blocked from use.

It should be appreciated that the bracket 60*a* could also be used, with minor modifications, to block a port adjacent port 16 in the "vertical" configuration, or any other configuration. The bracket 60*a* is illustrated for use in a "side-by-side" configuration of ports for exemplary purposes only.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A lock for a USB port, comprising:

a housing having a first end and a second end;

a retaining sheath having a first end connected to said second end of said housing and a second end configured for insertion to said USB port;

a locking member having a fixed end pivotally connected to said first end of said retaining sheath, a free end comprising at least one protrusion configured for insertion to a hole in said USB port, and a ramped camming surface disposed on said locking member;

a cam, slidable by a user within said housing along said ramped camming surface such that when said cam is slid toward said free end of said locking member, said locking member pivots at said fixed end such that said protrusion is inserted to said hole; and a locking mechanism configured to permit and restrain sliding of said cam away from said free end of said locking member when unlocked and locked, respectively, by a user.

2. The lock of claim 1, wherein said locking member is biased to extend at an angle such that said free end is disposed at an interior of said retaining sheath and said fixed end is disposed adjacent an exterior of said retaining sheath.

3. The lock of claim 1, wherein a first one of said at least one protrusion is disposed on a first edge of said locking member.

4. The lock of claim 3, further comprising a second protrusion disposed on a second edge of said locking member.

5. The lock of claim 1, wherein said ramped camming surface is substantially planar.

6. The lock of claim 1, wherein said ramped camming surface extends along at least a substantial portion of a length of said locking member.

7. The lock of claim 6, wherein said ramped camming surface extends along at least half a length of said locking member.

8. The lock of claim 1, wherein said locking mechanism comprises:

at least one first pin, having a first end and a second end;

at least one second pin having a first end and a second end, and biased in a first direction toward said first end, said first end selectively contacting said second end of a respective one of said at least one first pin;

a locking latch which, when moved in a second direction substantially perpendicular said first direction, prevents movement of said locking mechanism in said first direction;

wherein said first pin and said locking latch are biased in said second direction;

wherein said locking mechanism is attached to said cam and is biased in said first direction; and a key;

wherein said key is configured and dimensioned to press said first end of said first pin in a direction substantially opposite said first direction, such that said second end of said first pin and said first end of said second pin are disposed on a shear line;

and to subsequently press said first pin and said locking latch in a direction opposite said second direction.

9. The lock of claim 1, further comprising a security device for adjacent USB ports adapted for cooperation with said lock, said device comprising a member defining a first opening configured and dimensioned for receiving the lock and allowing securement of said security device to a first USB port, said member being configured and dimensioned to extend across and limit access to at least one said adjacent USB port when secured through said first opening to the first USB port.

10. The lock of claim 9 wherein said member is configured to completely block access to the at least one adjacent USB port.

11. The lock of claim 10, wherein said member comprises a flat plate.

12. The lock of claim 9, wherein said member is configured as a bracket dimensioned to mate with at least one USB plug such that the plug is securely retained in said at least one adjacent USB port by said member.

13. A lock for a USB port, comprising:

a housing;

a retaining sheath, attached at a rear end to a front end of said housing;

a cam, slidable in a forward and a backward direction by a user within said housing;

a locking member adjacent said cam, having a back end pivotably connected to said retaining sheath and a front end comprising at least one protrusion, said protrusion being configured and dimensioned for insertion into a hole in said USB port; and a locking mechanism that selectively retains said cam in said forward direction;

wherein said sliding of said cam in said forward direction pivots said locking member such that said protrusion pivots toward an exterior surface of said lock.

* * * * *